US006729230B1

(12) United States Patent
Okawa et al.

(10) Patent No.: US 6,729,230 B1
(45) Date of Patent: May 4, 2004

(54) CALENDAR ROLL CLEANING APPARATUS

(75) Inventors: Masayuki Okawa, Tochigi (JP); Kenichi Tanihata, Tokyo (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 119 days.

(21) Appl. No.: 09/612,271

(22) Filed: Jul. 7, 2000

(51) Int. Cl.[7] ..... B30B 15/30

(52) U.S. Cl. ..... 100/73; 100/102; 15/256.51; 101/425

(58) Field of Search ..... 100/73, 162 R, 100/74; 15/256.51; 101/425

(56) References Cited

U.S. PATENT DOCUMENTS 3,780,396 A * 12/1973 Werner ..... 15/256.51
4,344,361 A * 8/1982 MacPhee et al. ..... 101/425
4,953,252 A * 9/1990 Akisawa ..... 15/308
5,040,462 A * 8/1991 Hillenbrand et al. ..... 101/425
5,117,754 A * 6/1992 Nozaka et al. ..... 101/425
5,117,967 A * 6/1992 Morrow et al. ..... 15/256.51
5,255,549 A * 10/1993 Williams ..... 15/256.51

FOREIGN PATENT DOCUMENTS

JP A-3-176816 7/1991
JP A-8-180403 7/1996

* cited by examiner

*Primary Examiner*—Allen Ostrager
*Assistant Examiner*—J Nguyen
(74) *Attorney, Agent, or Firm*—Sughrue Mion, PLLC

(57) ABSTRACT

The present invention relates to a calender roll cleaning apparatus for smoothing a surface of a magnetic layer of a magnetic recording medium passed through a plurality of calender rolls. The cleaning apparatus comprises a wiping cloth feeding apparatus that feeds a calender roll surface wiping cloth at a definite rate and tension. A cleaning liquid supplying apparatus supplies a controlled amount of cleaning liquid such that the cleaning liquid permeates into the wiping cloth fed from the wiping cloth feeding apparatus. A wiping cloth pressing apparatus presses the permeated wiping cloth at a controlled pressing load.

4 Claims, 2 Drawing Sheets

CALENDAR ROLL CLEANING APPARATUS

BACKGROUND OF THE INVENTION

1. Field of the Invention

The present invention relates to a calender roll cleaning apparatus for smoothing a surface of a magnetic layer of a magnetic recording medium.

2. Description of the Related Art

During production of a magnetic recording medium, after coating a magnetic coating material on a non-magnetic support, a calender apparatus for smoothing a surface of a magnetic layer is used. The calender apparatus includes a plurality of calender rolls, that is, metal rolls and elastic rolls, alternately disposed. After placing the side of the magnetic layer of the magnetic recording medium next to the metal roll, the magnetic recording medium is fed into a nip portion located between the metal roll and the elastic roll, whereby the surface of the magnetic layer is smoothened.

However, in the calender apparatus, a binder, a hardening agent and a lubricant of the magnetic coating material coated on the magnetic recording medium are released, whereby the surfaces of the metal rolls or the elastic rolls are stained. Also, the stains on the surfaces of rolls are transferred onto the magnetic layer, etc. of the magnetic recording medium, thereby causing drop-out of the magnetic recording medium and spoiling the recording and reproducing qualities.

In order to remove the stains from the surfaces of the metal rolls of the calender apparatus, there has hitherto been proposed a roll cleaning apparatus that brings a cleaning tape into sliding contact with the surfaces of the metal rolls.

However, in this conventional roll cleaning apparatus, the cleaning tape is brought into sliding contact with the surfaces of the metal rolls in a dry system, and therefore, the stains on the roller surfaces cannot be adequately removed. As a result, production is interrupted every hour or two, and the stains on the surfaces of the metal rolls are wiped off by hand, resulting in poor productivity.

SUMMARY OF THE INVENTION

It is an object of the present invention to adequately remove the stains from the surfaces of the calender rolls and improve productivity of the calender treatment.

A first aspect of the present invention relates to a calender roll cleaning apparatus for smoothing a surface of a magnetic layer of a magnetic recording medium passed through a plurality of calender rolls. The cleaning apparatus comprises a wiping cloth feeding apparatus that feeds a calender roll surface wiping cloth at a definite rate and tension. A cleaning liquid supplying apparatus supplies a controlled amount of cleaning liquid such that the cleaning liquid permeates into the wiping cloth fed from the wiping cloth feeding apparatus. A wiping cloth pressing apparatus presses the permeated wiping cloth at a controlled pressing load.

Incidentally, the term "definite" of "definite tension" and "definite feeding rate" means a tension and a feeding rate, respectively, generated under a mechanically definite control. For example, not only does "definite feeding rate" include the case of setting the feeding rate to a definite rate of 10 cm/minute but also the case of varying the feeding rate by from 5 to 15 cm/minute by control rollers. The same logic is also applicable to the "definite tension."

A second aspect of the present invention relates to the calender roll cleaning apparatus according to the first aspect, wherein the cleaning liquid supplying apparatus is equipped with a porous member that oozes the cleaning liquid and is brought into contact with the wiping cloth.

A third aspect of the present invention relates to a calender roll cleaning apparatus according to the first or the second aspect, wherein the cleaning liquid supplying apparatus controls the cleaning liquid supply amount to the amount at which the cleaning liquid applied to the calender roll from the wiping cloth is vaporized before reaching a magnetic recording medium nip portion located between the rolls.

Still another aspect of the present invention relates to a calender roll cleaning apparatus according to any aspects above, wherein the feeding rate of the wiping cloth is from 3 to 60 cm/minute and the pressing load is from 5 to 7 kgf.

According the first aspect of the present invention, the following advantageous effects are obtained. The use of a fresh wiping cloth fed at a proper feeding rate from the wiping cloth feeding apparatus. The use of a wet wiping cloth permeated with a cleaning liquid is supplied at a proper amount controlled by the cleaning liquid supply apparatus. The use of a wiping cloth pressed against the calender rolls at a proper pressing load controlled by the wiping cloth pressing apparatus so as to adequately remove stains from the surfaces of the calender rolls.

According to the second aspect of the present invention, the following advantages are obtained. The cleaning liquid supply apparatus is equipped with a porous member that oozes a cleaning liquid. By contacting the porous member with the wiping cloth, the cleaning liquid is uniformly distributed throughout the entire wiping cloth, whereby the stains on the surfaces of the calender rolls are adequately removed.

According to the third aspect of the present invention, the following advantages are obtained. The cleaning liquid supply apparatus controls the cleaning liquid supply amount to the amount at which the cleaning liquid applied to the calender rolls from the wiping cloth is vaporized before reaching the magnetic recording medium nip portion of the rolls. Thus, the cleaning liquid applied to the calender rolls disappears immediately after acting to remove the stains from the surfaces of the calender rolls, whereby the cleaning liquid is not brought into contact with a magnetic recording medium in the nip portion of the calender rolls to dissolve the magnetic coating material coated thereon.

DESCRIPTION OF THE PREFERRED EMBODIMENTS

Figure 3:
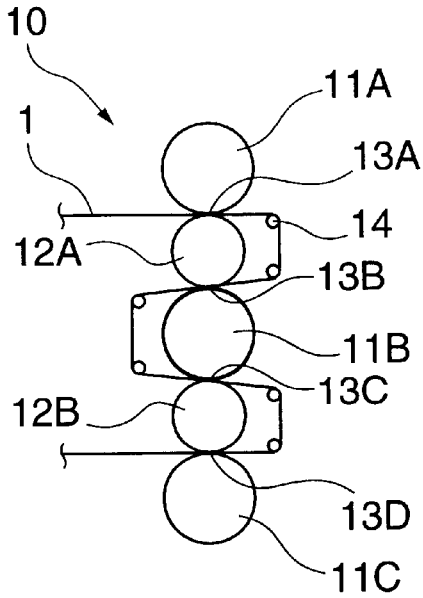
FIG. 3 is a schematic view showing a calender apparatus.

The calender apparatus 10 of FIG. 3 has, for example, three metal rolls 11A to 11C and two elastic rolls 12A and 12B alternately disposed in parallel. Nip portions 13A to 13D are formed between the adjacent metal roll 11A and elastic roll 12A, between the adjacent elastic roll 12A and metal roll 11B, between the adjacent metal roll 11B and elastic roll 12B, and between the adjacent elastic roll 12B and metal roll 11C, respectively. In the metal rolls 11A to 11C, for example, a chromium plating is applied to a surface of a steel roll, and the surface thereof is polished. The surfaces of the elastic rolls 12A and 12B are each provided with cotton, etc. Guide rolls 14 are also provided.

The calender apparatus 10 feeds a magnetic recording medium 1 while holding the medium using each of the nip portions 13A to 13D of the metal rolls 11A to 11C and the elastic rolls 12A and 12B. The magnetic layer side of the magnetic recording medium 1 faces the metal rolls 11A to 11C, and pressure and heat are applied to the magnetic layer of the magnetic recording medium 1, whereby the magnetic layer surface is smoothed.

Figure 1:
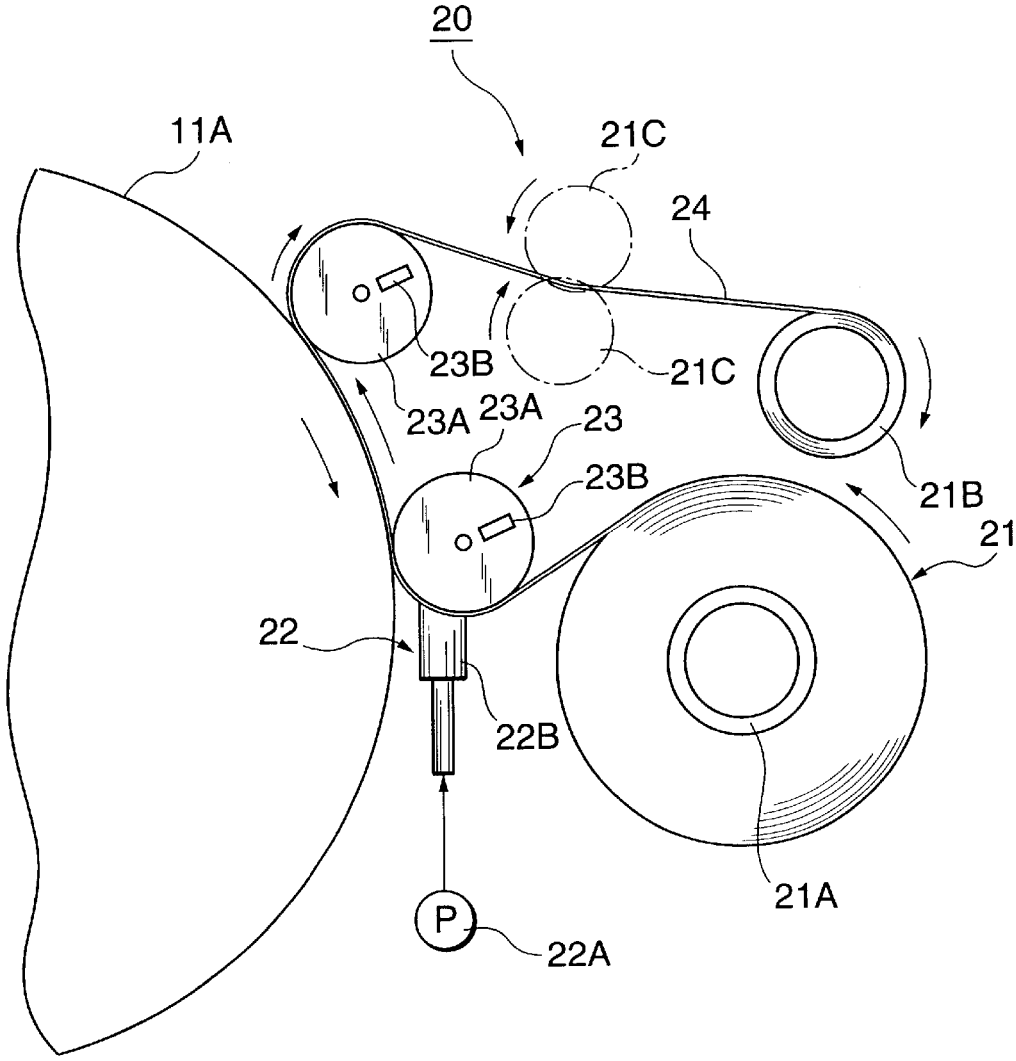
FIG. 1 is a schematic view showing a calender roll cleaning apparatus.
Figure 2:
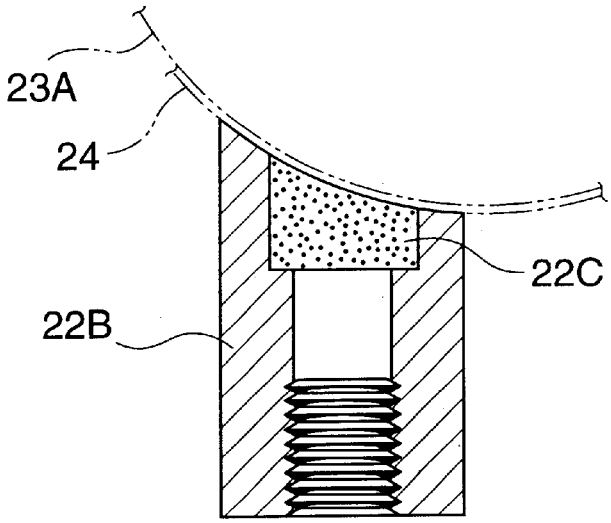
FIG. 2 is a schematic view showing a cleaning liquid supplying apparatus of the calender roll cleaning apparatus of FIG. 1.

However, in the calender apparatus 10, as shown in FIG. 1, a roll cleaning apparatus 20 is provided in each of the metal rolls 11A to 11C. In this case, the roll cleaning apparatus 20 can also be provided in each of the elastic rolls 12A and 12B. The roll cleaning apparatus 20 provided in the metal roll 11A (the same as the roll cleaning apparatus 20 provided in other metal rolls 11B, etc.) is hereinafter explained.

The roll cleaning apparatus 20 has a wiping cloth feeding apparatus 21, a cleaning liquid supply apparatus 22, and a wiping cloth pressing apparatus 23.

The wiping cloth feeding apparatus 21 has a brake-equipped unwinding reel 21A, a motor-equipped winding reel 21B, and feeding gears 21C. The wiping cloth feeding apparatus 21 feeds a wiping cloth 24 for wiping the surface of the metal roll 11A at a definite feeding rate while maintaining a definite tension. The feeding gears 21C are composed of a pair of adjustable driving spur gears holding the wiping cloth 24 and apply a feeding force to the wiping cloth 24.

The cleaning liquid supply apparatus 22 has a pump 22A and a supply head 22B. The cleaning liquid supply apparatus 22 supplies a cleaning liquid so that the cleaning liquid is permeated into the wiping cloth 24 fed from the wiping cloth feeding apparatus 21, and the supply amount thereof can be controlled by controlling the discharge amount of the pump 22.

The wiping cloth pressing apparatus 23 has two press rolls 23A, 23A and pressing apparatuses 23B, 23B for pressing the press rolls 23A, 23A against the metal roll 11A. The wiping cloth 24 fed from the unwinding reel 21A of the wiping cloth feeding apparatus 21 is wound around the press rolls 23A, 23A to regulate the feeding route of the wiping cloth 24 around the metal roll 11A. The wiping cloth 24 permeated with the cleaning liquid by the cleaning liquid supply apparatus 22 is pressed against the metal roll 11A, and the pressing load is controlled by press controlling the pressing apparatus 23B.

As the wiping cloth 24, for example, "SAVINA" (a Japanese Registered Trade Mark) "MINIFMAX" (a Japanese Registered Trade Mark) grade using super fine fibers made by Kanebo, Ltd., can be used. Also, as the cleaning liquid, a solvent for cleaning, for example, methyl ethyl ketone, can be used.

Also, in the cleaning liquid supply apparatus 22, the supply head 22B can be equipped with a porous member 22C made of, for example, a fluorocarbon resin sintered material. The porous member 22C is contacted with the wiping cloth 24 that is made to back up to the press roll 23A and can ooze the cleaning liquid into the wiping cloth 24.

Further, the cleaning liquid supply apparatus 22 controls the cleaning liquid supply amount by controlling the discharge amount of the pump 22A to the amount at which the cleaning liquid applied to the metal roll 11A from the wiping cloth 24 is vaporized before reaching the nip portion 13A located between the metal roll 11A and the elastic roll 12A.

The roll cleaning apparatus 20 performs the cleaning process in the following manner.

The fresh wiping cloth 24 unwound from the unwinding reel 21A of the wiping cloth feeding apparatus 21 is wound around the press rolls 23A, 23A and fed via the feeding route around the metal roll 11A at a definite tension and a definite rate. The cleaning liquid oozed from the porous member 22C of the supply head 22B of the cleaning liquid supply apparatus 22 is permeated into the wiping cloth 24. In this case, the supply amount of the cleaning liquid supplied to the wiping cloth 24 is controlled to the amount at which the cleaning liquid applied to the metal roll 11A from the wiping cloth 24 is vaporized before reaching the nip portion 13A located between the metal roll 11A and the elastic roll 12A. Finally, the wiping cloth 24 permeated with the cleaning liquid is pressed against the metal roll 11A by the wiping cloth pressing apparatus 23. In this case, the pressing load is controlled by the pressing apparatus 23B.

There are many advantages obtained by the present invention. The use of a fresh wiping cloth 24 fed at a proper feeding rate from the wiping cloth feeding apparatus 21. The use of a wet wiping cloth 24 permeated with a proper amount of cleaning liquid controlled by the cleaning liquid supply apparatus 22. The use of a wiping cloth 24 pressed against the calender roll 11A, etc. at a proper pressing load controlled by the wiping cloth pressing apparatus 23 so as to ensure that stains are removed from the surfaces of the calender roll 11A, etc.

The cleaning liquid supply apparatus 22 is equipped with the porous member 22C that oozes a cleaning liquid. By contacting the porous member 22C with the wiping cloth 24, the cleaning liquid is uniformly distributed throughout the entire wiping cloth 24, whereby the stains on the surfaces of the metal roll 11A, etc. are adequately removed.

The cleaning liquid supply apparatus 22 controls the cleaning liquid supply amount such that the cleaning liquid applied to the metal roll 11A, etc. from the wiping cloth 24 is vaporized before reaching the magnetic recording medium nip portion 13A, etc. of the roll 11A, etc. Thus, the cleaning liquid applied to the metal roll 11A, etc., disappears immediately after removing stains from the surfaces of the metal roll 11A, etc., such that the cleaning liquid is not brought into contact with a magnetic recording medium in the nip portion 13A, etc. of the metal roll 11A, etc. to dissolve the magnetic coating material coated thereon.

EXAMPLES

Preferred values of the cleaning working conditions of the roll cleaning apparatus 20 provided in the above-described calender apparatus 10 were as follows.

(A) Feeding Rate of the Wiping Cloth 24

A preferred value of the feeding rate of the wiping cloth 24 was from 3 cm/min. to 60 cm/min., and more preferably from 5 cm/min. to 40 cm/min.

(B) Supply Amount of the Leaning Liquid

Preferred values of the common values (gf/min) in the case of using methyl ethyl ketone as the cleaning liquid are shown in Table 1 with respect to the roll temperature of the metal roll 11A, etc. and the line speed of the magnetic recording medium 1.

TABLE 1

| Line speed m/min. | Roll temperature ° C. | Supply amount of Cleaning liquid gf/min. |
|---|---|---|
| 100 | 70 | 2.5 |
| | 80 | 4.4 |
| | 90 | 6.8 |
| 200 | 80 | 6.5 |
| | 90 | 8.2 |

(C) Pressing Load of the Wiping Cloth 24

A preferred value of the pressing load of the wiping cloth 24 was from 5 to 7 kgf.

A specific embodiment of the present invention has been described in detail with reference to the attached drawings. However, the invention is not limited thereto. Variations may be made without deviating from the spirit and scope of the invention.

What is claimed is:

1. A calender roll cleaning apparatus for smoothing a surface of a magnetic layer of a magnetic recording medium passed through a plurality of calender rolls, comprising:

a wiping cloth feeding apparatus that feeds a calender roll surface wiping cloth at a definite rate and tension;

a cleaning liquid supplying apparatus that supplies a controlled amount of cleaning liquid such that the cleaning liquid permeates into the wiping cloth fed from the wiping cloth feeding apparatus; and a wiping cloth pressing apparatus that presses the permeated wiping cloth at a controlled pressing load, wherein the cleaning liquid supplying apparatus controls the cleaning liquid supply amount to an amount at which the cleaning liquid applied to the calender roll from the wiping cloth is vaporized before reaching a magnetic recording medium nip portion located between the rolls, and wherein the cleaning liquid supplying apparatus is equipped with a porous member that oozes the cleaning liquid, and the porous member is brought into contact with the wiping cloth, whereby the cleaning liquid is uniformly distributed throughout the entire wiping cloth.

2. The calender roll cleaning apparatus as claimed in claim 1, wherein the cleaning liquid supplying apparatus controls the cleaning liquid supply amount to an amount at which the cleaning liquid applied to the calender roll from the wiping cloth is vaporized before reaching a magnetic recording medium nip portion located between the rolls.

3. The calender roll cleaning apparatus as claimed in claim 1, wherein the feeding rate of the wiping cloth is from 3 to 60 cm/minute and the pressing load is from 5 to 7 kgf.

4. The calender roll cleaning apparatus as claimed in claim 1, wherein the feeding rate of the wiping cloth is from 3 to 60 cm/minute and the pressing load is from 5 to 7 kgf.

* * * * *